US009587841B2

(12) United States Patent
Cho et al.

(10) Patent No.: US 9,587,841 B2
(45) Date of Patent: Mar. 7, 2017

(54) TURBO FAN AND CEILING TYPE AIR CONDITIONER USING THE SAME

(71) Applicant: LG ELECTRONICS INC., Seoul (KR)

(72) Inventors: Namjoon Cho, Seoul (KR); Kyungrock Kim, Seoul (KR); Dongkeun Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 419 days.

(21) Appl. No.: 14/164,678

(22) Filed: Jan. 27, 2014

(65) Prior Publication Data

US 2014/0231051 A1 Aug. 21, 2014

(30) Foreign Application Priority Data

Feb. 21, 2013 (KR) ..... 10-2013-0018657

(51) Int. Cl.

| | |
|---|---|
| ***F24F 1/38*** | (2011.01) |
| ***F24F 1/00*** | (2011.01) |
| ***F04D 29/28*** | (2006.01) |
| ***F04D 29/30*** | (2006.01) |

(52) U.S. Cl.

CPC ..... *F24F 1/0022* (2013.01); *F04D 29/281* (2013.01); *F04D 29/30* (2013.01); *F24F 1/0007* (2013.01); *F24F 1/0014* (2013.01); *F24F 2001/0037* (2013.01)

(58) Field of Classification Search

CPC ..... F24F 1/0022; F24F 1/0014; F24F 1/0007; F24F 2001/0037; F24F 13/068; F04D 29/281; F04D 29/282; F04D 29/284; F04D 29/30

See application file for complete search history.

(56) References Cited

U.S. PATENT DOCUMENTS

| | | | | |
|---|---|---|---|---|
| 5,667,360 | A * | 9/1997 | Hauser | F04D 29/023 416/183 |
| 6,755,615 | B2 * | 6/2004 | Chapman | F04D 29/023 415/206 |
| 7,670,115 | B2 * | 3/2010 | Cho | F04D 29/281 416/186 R |

(Continued)

FOREIGN PATENT DOCUMENTS

| | | |
|---|---|---|
| EP | 0926452 | 6/1999 |
| JP | 02-166323 | 6/1990 |

(Continued)

OTHER PUBLICATIONS

European Search Report dated Aug. 25, 2014.

*Primary Examiner* — Christopher Verdier
(74) *Attorney, Agent, or Firm* — KED & Associates LLP

(57) ABSTRACT

Provided are a turbo fan and an air conditioner using the same. The turbo fan includes a main plate rotating by power provided from a fan motor, a blade having one end connected to the main plate to rotate, a shroud connected to the other end of the blade, and an orifice guiding a flow of indoor air in a direction of the shroud. The shroud includes a guide surface defining one surface of the shroud, the guide surface having a predetermined curvature and an air guide connected to a side of the shroud, the air guide being disposed in a direction of the orifice from the shroud.

14 Claims, 6 Drawing Sheets

(56) References Cited

U.S. PATENT DOCUMENTS

| | | | | |
|---|---|---|---|---|
| 8,007,240 | B2 * | 8/2011 | Sanagi | F04D 29/282 29/889.4 |
| 2002/0028138 | A1 * | 3/2002 | Lee | F04D 29/023 415/206 |
| 2008/0134713 | A1 * | 6/2008 | Choi | F04D 29/30 62/407 |
| 2010/0202886 | A1 * | 8/2010 | Iwata | F04D 29/282 416/182 |
| 2012/0045338 | A1 * | 2/2012 | Tadokoro | F04D 29/30 416/196 R |
| 2012/0063899 | A1 * | 3/2012 | Ikeda | F04D 25/088 416/146 R |

FOREIGN PATENT DOCUMENTS

| | | | | |
|---|---|---|---|---|
| JP | 04-263717 | | 9/1992 | |
| JP | EP0926452 | A1 * | 6/1998 | F24F 1/00 |
| JP | 2007-107435 | | 4/2007 | |
| KR | 10-2003-0089142 | | 11/2003 | |

* cited by examiner

-RELATED ART-

TURBO FAN AND CEILING TYPE AIR CONDITIONER USING THE SAME

CROSS-REFERENCE TO RELATED APPLICATION

The present application claims priority under 35 U.S.C. 119 and 35 U.S.C. 365 to Korean Patent Application No. 10-2013-0018657 (filed on Feb. 21, 2013), which is hereby incorporated by reference in its entirety.

BACKGROUND

The present disclosure relates to a turbo fan and a ceiling type air conditioner using the same.

In general, ceiling type air conditioners are apparatuses which are buried into an indoor ceiling to introduce indoor air and discharge heat-exchanged air into an indoor space. In such a ceiling type air conditioner, air may be suctioned through a suction hole defined in a center of the air conditioner, and the suctioned air may be air-conditioned by a heat exchanger disposed within the ceiling type air conditioner. The air-conditioned air may be discharged into the indoor space through a discharge part disposed on an edge of the ceiling type air conditioner to adjust a temperature and humidity in the indoor space.

FIG. 1 is a cross-sectional view illustrating an inner structure of an indoor unit of a ceiling type air conditioner according to a related art.

Referring to FIG. 1, an indoor unit 10 of the ceiling type air conditioner according to the related art may include a case 20 installed in a ceiling and a turbo fan 30 accommodated in the case 20 and having a plurality of blades 31. The turbo fan 30 may be operated by a motor 32 that provides power. The motor may be attached to a predetermined plate (not shown) to operate the turbo fan 30.

Also, the turbo fan 30 may include an orifice 17 guiding indoor air so that the indoor air is suctioned into the turbo fan 30 and a shroud 50 guiding the air passing through the orifice 17 into a heat exchanger 40.

A gap 15 may be defined between the shroud 50 and the orifice 17. When an amount of air passing through the turbo fan 30 is greater than that of air to be discharged into the indoor space, the air may be suctioned again into the turbo fan 30 through the gap 15.

A suction hole 90 for suctioning the indoor air may be defined in a center of the indoor unit 10, and a plurality of discharge holes 60 may be defined outside the suction hole 90.

When the indoor unit 10 is operated for a predetermined time, the motor 32 may increase in temperature. Thus, a cooling passage 80 having a predetermined distance may be defined between the turbo fan 30 and a bottom surface of the case 20.

Hereinafter, an operation of the ceiling type air conditioner according to the related art will be described.

When the indoor unit 10 of the ceiling type air conditioner is operated, the motor 32 may be operated to operate the turbo fan 30. Also, the indoor air suctioned through the suction hole 90 may be suctioned into a central portion of the turbo fan 30 by the operation of the turbo fan 30. Here, the orifice 17 may guide the indoor air suctioned through the suction hole 90 so that the indoor air is suctioned into the central portion of the turbo fan 30.

The suctioned indoor air may be heat-exchanged through the heat exchanger 40 disposed on a circumference of the turbo fan 30. That is, the air introduced into the turbo fan 30 may be guided into the heat exchanger 40 by the shroud 50.

Also, the heat-exchanged air may be supplied into the indoor space through the plurality of discharge holes 60 defined outside the suction hole 90.

However, a speed of the air passing through an upper portion of the heat exchanger 40 and a speed of the air passing through a lower portion of the heat exchanger 40 may be different from each other with respect to the center of the heat exchanger 40. That is, according to characteristics of the ceiling type air conditioner, since the motor 32 of the indoor unit 10 is attached to the ceiling, the turbo fan has to be fixed to an upper end of the ceiling type air conditioner. Thus, a speed of the air passing through the upper portion of the heat exchanger 40 may be greater than that of the air passing through the lower portion of the heat exchanger 40.

That is to say, a speed of the air passing through a lower portion of the turbo fan 30 may be relatively less than that of the air passing through an upper portion of the turbo fan 30. Thus, the air passing through the lower portion of the turbo fan 30 may not pass through the heat exchanger, but drop down.

The air dropping down may pass through the gap 15 defined between the shroud 50 and the orifice 17 and then be suctioned again into the turbo fan 30.

However, if an amount of air passing through the gap 15 exceeds a predetermined value, an amount of air passing through the discharge hole 60 may decrease. Thus, the whole system may be deteriorated in efficiency. In addition, a flow loss of the air may cause degradation in performance of the turbo fan 30.

SUMMARY

Embodiments provide a turbo fan that prevents air passing through the turbo fan from being suctioned again into the turbo fan through a gap defined between a shroud and an orifice and a ceiling type air conditioner using the same.

In one embodiment, a turbo fan includes: a main plate rotating by power provided from a fan motor; a blade having one end connected to the main plate to rotate; a shroud connected to the other end of the blade; and an orifice guiding a flow of indoor air in a direction of the shroud, wherein the shroud includes: a guide surface defining one surface of the shroud, the guide surface having a predetermined curvature; and an air guide connected to a side of the shroud, the air guide being disposed in a direction of the orifice from the shroud.

In another embodiment, a ceiling type air conditioner includes: a case defining an exterior thereof, the case having a suction hole through which indoor air is suctioned; a turbo fan disposed within the case to change a flow direction of air passing through the suction hole; and a heat exchanger disposed outside the turbo fan, wherein the turbo fan includes: a main plate rotating by power provided from a fan motor; a blade having one end connected to the main plate to rotate; a shroud connected to the other end of the blade; and an orifice guiding a flow of the indoor air in a direction of the shroud, wherein the shroud includes: a guide surface defining one surface of the shroud, the guide surface having a predetermined curvature; and an air guide connected to a side of the shroud, the air guide being disposed in a direction of the orifice from the shroud.

The details of one or more embodiments are set forth in the accompanying drawings and the description below.

Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
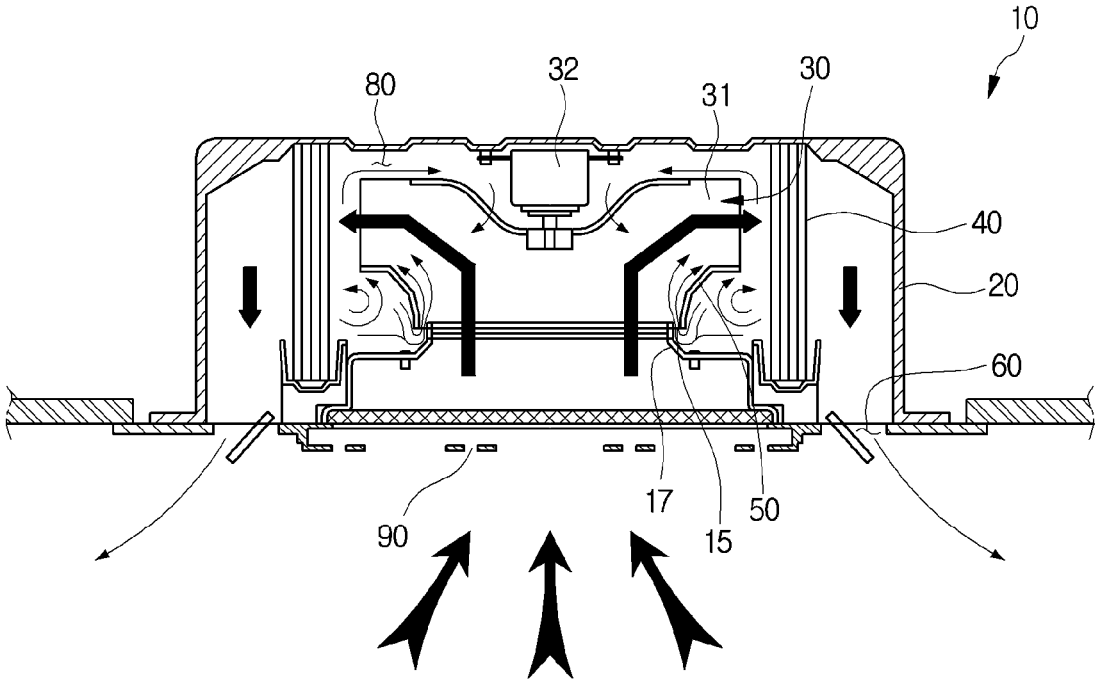
FIG. 1 is a cross-sectional view illustrating an inner structure of an indoor unit of a ceiling type air conditioner according to a related art.
Figure 2:
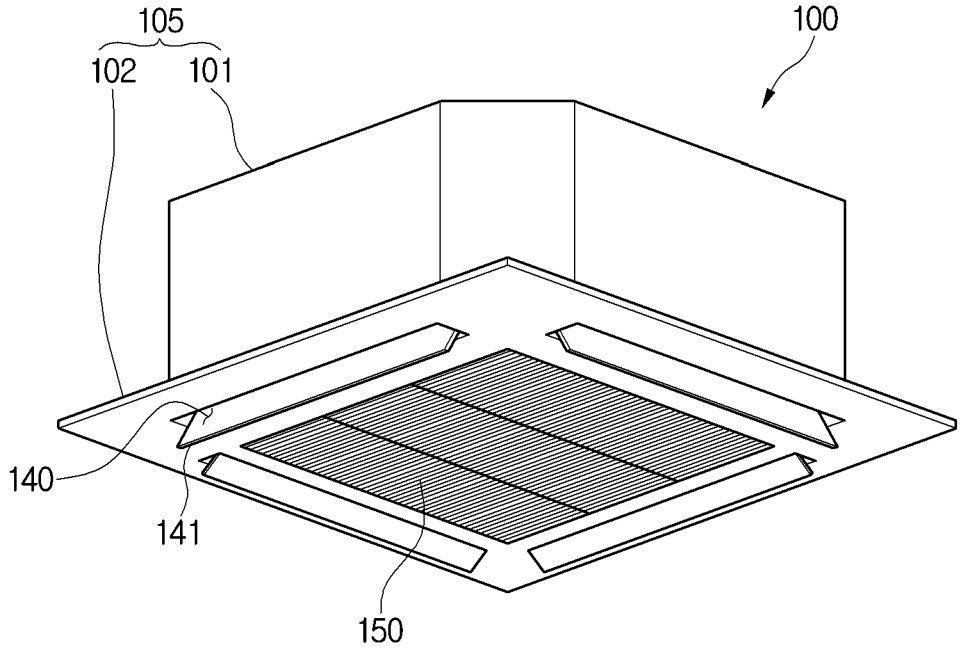
FIG. 2 is a perspective view of an indoor unit of a ceiling type air conditioner according to an embodiment.
Figure 3:
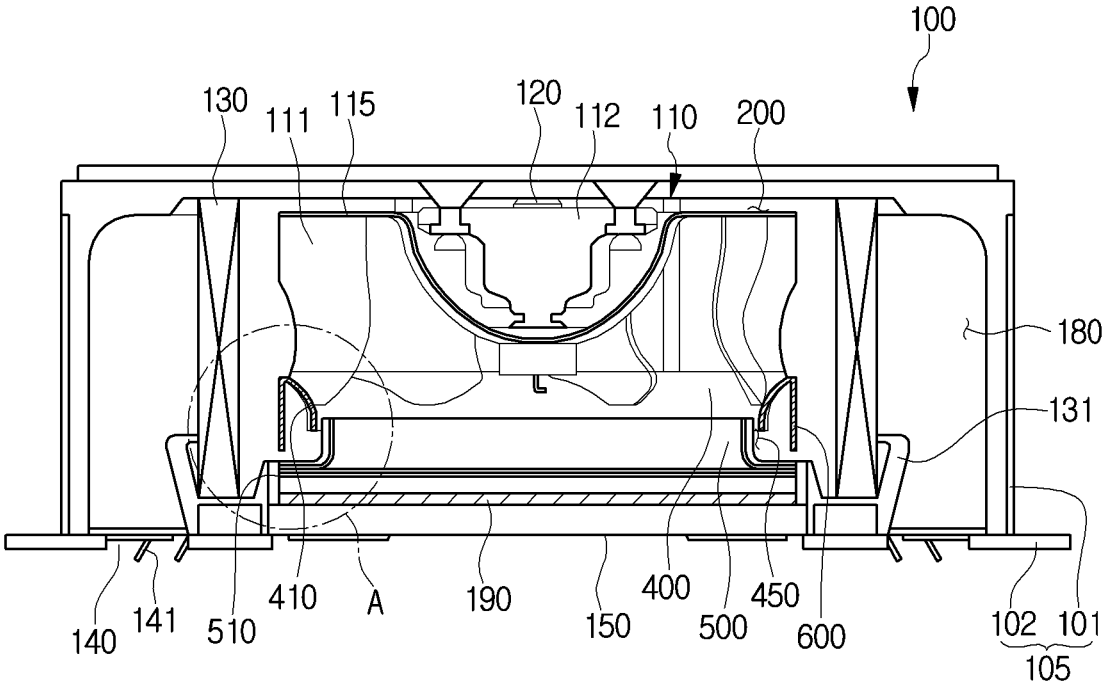
FIG. 3 is a cross-sectional view of the indoor unit of the ceiling type air conditioner according to an embodiment.
Figure 4:
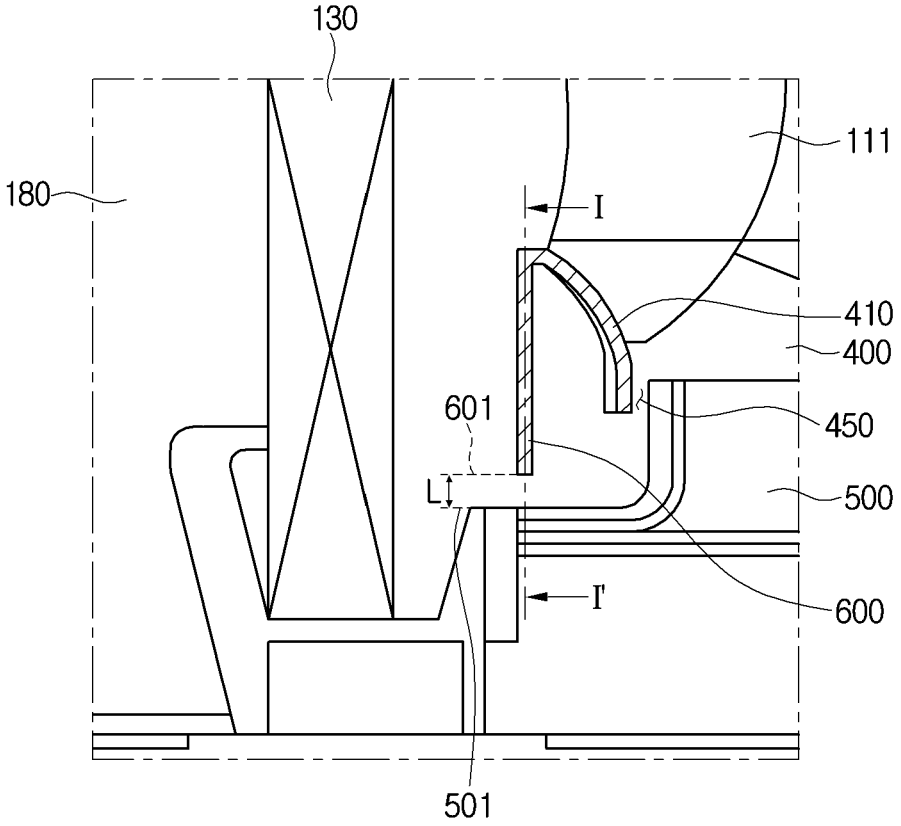
FIG. 4 is a partially enlarged view of a portion A of FIG. 3.

FIG. 2 is a perspective view of an indoor unit of a ceiling type air conditioner according to an embodiment, FIG. 3 is a cross-sectional view of the indoor unit of the ceiling type air conditioner according to an embodiment, and FIG. 4 is a partially enlarged view of a portion A of FIG. 3.

Referring to FIGS. 2 to 4, the ceiling type air conditioner according to an embodiment may include an outdoor unit (not shown) installed in an outdoor space, an indoor unit 100 installed in an indoor space, and a refrigerant tube (not shown) connecting the outdoor unit (not shown) to the indoor unit 100 and through which a refrigerant flows.

The indoor unit 100 may include a case 105 defining an exterior thereof, a turbo fan 110 disposed within the case 105, a fan motor 120 coupled to the turbo fan 110 to provide power, and a heat exchanger 130 disposed outside the fan motor 120.

The case 105 may include a main body 101 defining side surfaces thereof and a front panel 102 coupled to the main body 101 to define a front surface thereof.

The main body 101 may be installed in an indoor ceiling. Also, the main body 101 may have an opened lower portion to communicate with a suction hole 150 defined in the front surface of the front panel 102. The main body 101 may be installed in the indoor ceiling in consideration of space availability and beauty. However, the present disclosure is not limited to the installation space of the main body 101. For example, the main body 101 may be installed in an indoor sidewall.

The front panel 102 may be detachably coupled to the lower portion of the main body 101. Also, the front panel 102 may be exposed to the indoor space so that air is suctioned into or discharged from the indoor unit 100. The front panel 102 may cover the opened portion of the main body 101. For example, the front panel 102 may have a square plate shape to cover an opening of the main body 101. Also, the front panel 102 may include a suction hole 150 for suctioning the indoor air and discharge holes for discharging air into the indoor space.

The suction hole 150 may be disposed at a central portion of the front panel 102. Also, the discharge holes 140 may be disposed symmetrical to each other in four sides outside the suction hole 150. The suction hole 150 may have a grill structure. The discharge hole 140 may have a rectangular structure having a predetermined width and length. However, the present disclosure is not limited to the shapes of the suction hole 150 and the discharge hole 140.

Also, a filter 190 for removing various foreign substances contained in the air suctioned into the main body 101 through the suction hole 150 may be disposed inside the front panel 102.

The turbo fan 110 may be disposed at a position corresponding to that of the suction hole 150 to improve suction efficiency of the air suctioned into the main body 101. Particularly, in FIG. 3, the turbo fan 110 may be disposed to vertically correspond to the suction hole 150.

Also, the turbo fan 110 may blow the indoor air suctioned through the suction hole 150 into the heat exchanger 130.

The heat exchanger 130 may surround the outside of the turbo fan 110. For example, the heat exchanger 130 may have a square structure to correspond to that of a side surface of the main body 101. The heat exchanger 130 may heat-exchange the air suctioned into the main body 101 through the turbo fan 110. Particularly, when the ceiling type air conditioner operates in a cooling mode, the air passing through the heat exchanger 130 may decrease in temperature. When the ceiling type air conditioner operates in a heating mode, the air passing through the heat exchanger 130 may increase in temperature.

A drain plate 131 receiving condensed water that is generated while the refrigerant passing through the heat exchanger 130 is heat-exchanged with the indoor air may be disposed under the heat exchanger 130. Also, the drain plate 131 may be connected to a drain tube (not shown) for the condensed water collected in the drain plate 131 to the outside.

A guide passage 180 for guiding a flow direction of air may be defined in an outer portion of the inside of the main body 101. Particularly, the guide passage 180 may guide the air heat-exchanged by the heat exchanger 130 to the discharge hole 140.

A vane 141 for controlling the flow direction of the air may be disposed in the discharge hole 140. The vane 141 may rotate at a predetermined angle. Also, the vane 141 may be inclined outward from the front surface of the front panel 102. This is done for supplying a uniform wind speed into all regions of the indoor space. However, the present disclosure is not limited to the rotation direction of the vane 141. Also, the present disclosure is not limited to the arrangement, constitution, and operation method of the vane 141.

Also, in the ceiling type air conditioner according to the current embodiment, a cooling passage 200 for cooling heat generated in the fan motor 120 may be provided.

The fan motor 110 may include a hub 112 connected to a rotation shaft of the fan motor 120, a main plate 115 rotated by the fan motor 120, a plurality of blades 111 connected to the main plate 115 and disposed at a predetermined distance along a circumference of the main plate 115, and a shroud 400 disposed to face the main plate 115 and connected to the other ends of the plurality of blades 111. Also, the turbo fan 110 may further include an orifice 500 spaced a predetermined distance from the shroud 400.

The orifice 500 may guide the introduction of the air into the suction hole 150 when the turbo fan 110 is rotated. Also, the shroud 400 which may guide the movement of the air to radially discharge the air introduced into the turbo fan 110 through the orifice 500.

A gap 450 providing a moving path of an air may be defined between the shroud 400 and the orifice 500. The gap 450 may suction air again into the turbo fan 110 when an amount of air passing through the turbo fan 110 is greater than that of air to be discharged into the indoor space.

The ceiling type air conditioner according to the current embodiment may further include an orifice support part 510 for fixing the orifice 500. The orifice support part 510 may extend outward from each of one side and the other side of the orifice 500. Also, the orifice support part 510 may disposed in parallel with the main plate 115.

The shroud 400 may have a guide surface 410 for the air suctioned from the suction hole 150 into the heat exchanger 130 which may be defined on the shroud 400. The guide surface 410 may have a curved shape. That is, the guide surface 410 may guide the air so that the air more smoothly flows when the air suctioned from the suction hole 150 flows into the heat exchanger 130 by the operation of the turbo fan 110.

The guide surface 410 may surround a lower portion of the turbo fan 110. That is, the guide surface 410 may have a closed loop shape. Thus, the guide surface 410 may be disposed on a front surface of the shroud 400 between inner and outer circumferential surfaces of the shroud 400. Here, a space in which the inner circumferential surface of the shroud 400 is defined may be a hollow. That is, a shroud hollow may be defined in a central portion of the guide surface 410. Also, the shroud hollow may communicate with the suction hole 150.

That is, a hollow through which the air suctioned through the suction hole 150 is discharged into the turbo fan 110 may be defined in centers of the shroud 400 and the orifice 500. If the hollow defined in the center of the shroud 400 is called a shroud hollow, and the hollow defined in the center of the orifice 500 is called an orifice hollow, the shroud hollow and the orifice hollow may vertically communicate with each other. That is, the air introduced through the suction hole 150 may successively pass through the shroud hollow and the orifice hollow.

Also, the turbo fan 110 may further include an air guide 600 extending in one direction with respect to one surface of the shroud 400. Particularly, the air guide 600 may be disposed on a portion facing the guide surface 410 when viewed with respect to the shroud 400. That is, the air guide 600 may be disposed on a back surface of the shroud 400.

Thus, the shroud hollow may be defined in the space in which the inner circumferential surface of the shroud is defined, and the air guide may be disposed on the outer circumferential surface of the shroud.

Also, the air guide 600 may be disposed in a direction perpendicular to the main plate 115 with respect to one side of the shroud 400. That is, the air guide 600 may be disposed in a direction perpendicular to the orifice support part 510. However, the present disclosure is not limited to the position of the air guide 600.

The air guide 600 and the shroud 400 may be integrated with each other. Alternatively, the air guide 600 and the shroud 400 may be separately manufactured, and then be coupled to each other. That is, the present disclosure is not limited to the connection method between the air guide 600 and the shroud 400.

An end of the air guide 600 spaced apart from the shroud 400 may be disposed at a portion higher than that of the orifice support part 510. That is, if a surface defined when the orifice support part 510 extends in a direction parallel to that of the main plate 115 is defined as an orifice extension part 501, and a surface defined when the end of the air guide 600 extends in a direction parallel to that of the main plate 115 is defined as a guide extension part 601, a vertical distance between the orifice extension part 501 and the guide extension part 601 may be a distance L.

The vertical distance between the orifice extension part 501 and the guide extension part 601 may be a distance enough to suction the air passing through the turbo fan 110 again into the turbo fan 110. That is, the present disclosure is not limited to the distance L.

The air guide 600 may block the suction of the air passing through the turbo fan 110 again into the turbo fan 110.

In detail, the speed of the air passing through the lower portion of the turbo fan 110 may be relatively less than that of the air passing through the upper portion of the turbo fan 110. Thus, the air passing through the lower portion of the turbo fan 110 may not pass through the heat exchanger 130, but drop down.

The air dropping down may pass through the gap 450 defined between the shroud 400 and the orifice 500 and then be suctioned again into the turbo fan 110.

However, if an amount of air passing through the gap 10 exceeds a predetermined value, an amount of air passing through the discharge hole 140 may decrease. Thus, the air guide 600 may be disposed on the shroud 400 to prevent the air from being suctioned again into the turbo fan 110 by passing through the gas 450 due to the air guide 600.

Hereinafter, the air guide 600 will be described.

Figure 5:
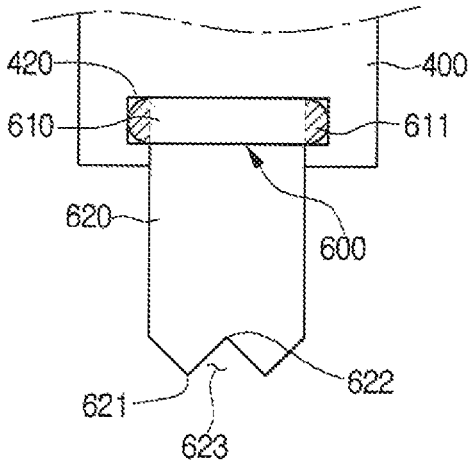
FIG. 5 is a partial cross-sectional view taken along line I-I' of FIG. 4.

FIG. 5 is a partial cross-sectional view taken along line I-I' of FIG. 4.

Referring to FIG. 5, the air guide 600 according to the current embodiment may include a head 610 contacting a side of the shroud 400 and a body 620 connected to the head 610 to define a main body of the air guide 600.

A recess part 420 may be defined in a back surface of the shroud 400 so that the shroud 400 is coupled to the head 610. The recess part 420 may have a groove shape that is recessed from the back surface of the shroud 400 in one direction.

Also, the head 610 may include an elastic part 611 disposed outside the head 610 and having predetermined elastic force.

The recess part 420 may include a lower portion that is disposed adjacent to the back surface of the shroud 400 and an upper portion that is disposed relatively closer to the front surface of the shroud 400 than the lower portion and has a diameter greater than that of the lower portion. Also, the head 610 may have a diameter corresponding to that of the upper portion.

The lower portion of the recess part 420 may have a width less than that of the head 610, and the upper portion of the recess part 420 may have a width corresponding to that of the head 610 when viewed in a direction forward from the back surface of the shroud 400.

The head 610 may have an outer circumferential surface that is constituted by the elastic part 611 formed of a predetermined elastic material. Thus, when the head 610 and the recess part 420 are coupled to each other, the elastic part 611 may be inserted into the lower portion of the recess part 420 in a state where the elastic part 611 is closely attached to an outer circumferential surface of the recess part 420. When the head 610 moves into the upper portion of the recess part 420, the elastic part 611 may return to its original shape by the elastic force of the elastic part 611.

Also, a protrusion 621 protruding in one direction with respect to a length direction of the body 620 and a groove 622 protruding in the other direction may be disposed on a lower portion of the body 620 that is one component of the air guide 600. The protrusion 621 and the groove 622 may be provided in plurality. Also, the protrusion 621 and the groove 622 may be alternately disposed with respect to each other.

A bent part 623 for blocking an air flow may be disposed in the plurality of grooves 622. An eddy may be formed in the bent part 623 by the plurality of protrusions 621 and the plurality of grooves 622. Thus, a flow of the air passing through the turbo fan 110 may be blocked by the eddy formed in the bent part 623 when the air flows into the gap 450.

That is, it may prevent the air passing through the turbo fan 110 from being suctioned again into the turbo fan 110 by the eddy formed in the bent part 623.

Figure 6:
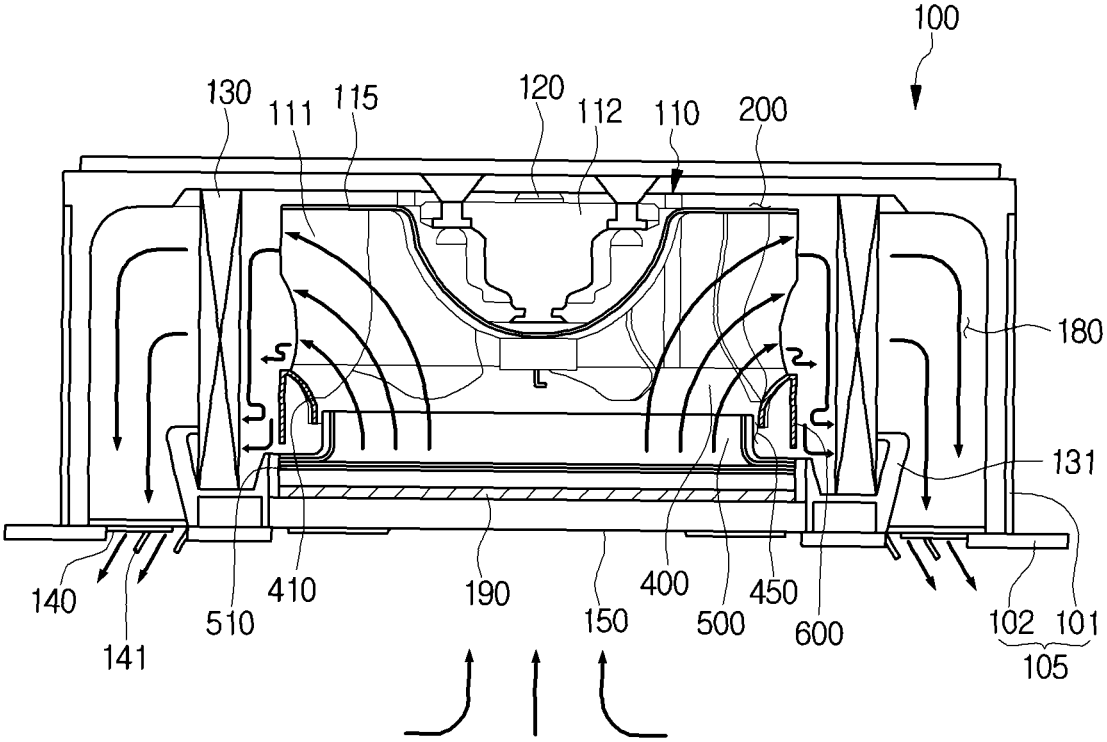
FIG. 6 is a schematic view illustrating a flow of air passing through the ceiling type air conditioner according to an embodiment.

FIG. 6 is a schematic view illustrating a flow of air passing through the ceiling type air conditioner according to an embodiment.

FIG. 6 is a view illustrating a flow of air on the basis of the structure of FIG. 3, and thus, the same components as those of FIG. 3 will be denoted by the same reference numerals.

Referring to FIG. 6, when the ceiling type air conditioner according to the current embodiment operates, the indoor unit 100 connected to the outdoor unit (not shown) may operate. When the indoor unit 100 operates, the main plate 115 may rotate by the operation of the fan motor 120. As the main plate 115 rotates, the plurality of blades 111 connected to the main plate 115 may rotate. When the plurality of blades 111 rotate, the indoor air may be suctioned through the suction hole 150 installed in the center of the front panel 102 of the indoor unit 100. Foreign substances contained in the suctioned air may be filtered while passing through the filter 190. Here, a flow of the air may be guided into the turbo fan 110.

The air introduced into the turbo fan 110 may be radially discharged due to the rotation of the plurality of blades 111. That is, the air introduced downward may be discharged laterally by the operation of the turbo fan 110. The shroud 400 may be disposed under the turbo fan 110 to guide the flow of the air. Also, the guide surface 410 having a curved shape to smoothly guide the flow of the air may be disposed on the front surface of the shroud 400.

The air discharged from the blades 111 may be heat-exchanged with the refrigerant that passes through the inside of the heat exchanger 130 while passing through the heat exchanger 130. Here, a speed of the air passing through the upper portion of the heat exchanger 130 may be greater than that of the air passing through the lower portion of the heat exchanger 130. That is, the speed of the air passing through the upper portion of the turbo fan 110 may be greater than that of the air passing through the lower portion of the turbo fan 110.

Thus, the air passing through the lower portion of the turbo fan 110 may not pass through the heat exchanger 130, but drop down. Here, the dropping down air may be suctioned again into the turbo fan 110 in which a relatively low pressure is formed through the gap 450 defined between the shroud 400 and the orifice 500. However, the flow of the air may be blocked by the air guide 600 disposed on the back surface of the shroud 400. Thus, the air may be minimized in flow loss by the air guide 600, and the air may smoothly flow.

The air guided in flow by the air guide 600 to pass through the heat exchanger 130 may pass through the discharge hole 140 to condition the indoor air.

Also, the plurality of vanes 141 may be disposed in the discharge hole 140 to adequately air-condition the indoor space.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A turbo fan comprising:

a main plate rotated by a fan motor;

a blade having one end rotatable connected to the main plate;

a shroud connected to the other end of the blade; and an orifice that guides a flow of indoor air towards the shroud, wherein the shroud includes:

a guide surface that definies one surface of the shroud, the guide surface having a predetermined curvature; and an air guide connected to a side of the shroud, the air guide being extended in a direction of the orifice from the shroud, wherein the guide surface is defined on a front surface of the shroud, and the air guide is installed on a back surface of the shroud, and wherein the air guide includes:

a head coupled to the back surface of the shroud; and a body connected to the head to block a flow of the air, wherein a recess is defined in the back surface of the shroud into which the head is inserted.

2. The turbo fan according to claim 1, wherein the orifice includes:

an orifice support disposed in parallel with the main plate to support the orifice; and an orifice hollow defined in a center of the orifice to provide a suction passage of the air.

3. The turbo fan according to claim 2, wherein a shroud hollow is defined in a center of the guide surface, and the orifice hollow and the shroud hollow vertically communicate with each other.

4. The turbo fan according to claim 3, wherein the shroud hollow is defined at an inner circumferential surface of the shroud, and the air guide is provided on an outer circumferential surface of the shroud.

5. The turbo fan according to claim 2, wherein the air guide is spaced a predetermined distance from the orifice support.

6. The turbo fan according to claim 5, wherein the air guide extends in a direction perpendicular to a direction in which the orifice support extends.

7. The turbo fan according to claim 1, wherein the air guide is integrated with the shroud.

8. The turbo fan according to claim 1, wherein the recess includes:

a lower portion disposed adjacent to the back surface of the shroud; and an upper portion disposed relatively closer to the front surface of the shroud than the lower portion, the upper portion having a diameter greater than a diameter of the lower portion, and wherein the head has a diameter corresponding to the diameter of the upper portion.

9. The turbo fan according to claim 8, wherein an elastic material is provided on an outer circumferential surface of the head.

10. The turbo fan according to claim 1, wherein a protrusion that protrudes from one surface of the body by a predetermined length and a groove recessed from the one surface of the body by a predetermined length are provided on the body, and wherein a bent part to allow air passing through the body to generate an eddy is provided in the groove.

11. A ceiling type air conditioner comprising:

a case that defines an exterior thereof, the case having a suction hole through which indoor air is suctioned;

a turbo fan provided within the case to change a flow direction of air passing through the suction hole; and a heat exchanger provided outside of the turbo fan, wherein the turbo fan includes:

a main plate rotated by a fan motor;

a blade having one end rotatably connected to the main plate;

a shroud connected to the other end of the blade; and an orifice that guides a flow of the indoor air towards the shroud, wherein the shroud includes:

a guide surface that defines one surface of the shroud, the guide surface having a predetermined curvature; and an air guide connected to a side of the shroud, the air guide being extended in a direction of the orifice from the shroud, wherein the air guide includes:

a head coupled to the back surface of the shroud; and a body connected to the head to block a flow of the air, wherein a recess is defined in the back surface of the shroud into which the head is inserted.

12. The air conditioner according to claim 11, wherein the guide surface surrounds a lower outer surface of the blade, a shroud hollow that forms a suction passage of the air is defined in a center of the guide surface, and the shroud hollow communicates with the suction hole.

13. The air conditioner according to claim 12, wherein the shroud hollow is defined at an inner circumferential surface of the shroud, and the air guide is provided on an outer circumferential surface of the shroud.

14. The air conditioner according to claim 11, further including an orifice support provided on a bottom surface of the orifice in parallel with the main plate to support the orifice, wherein the air guide is provided a predetermined distance from the orifice support.

* * * * *